United States Patent [19]

Kuwahara

[11] Patent Number: 5,072,228

[45] Date of Patent: Dec. 10, 1991

[54] PHASED ARRAY ANTENNA WITH TEMPERATURE COMPENSATING CAPABILITY

[75] Inventor: Yoshihiko Kuwahara, Tokyo, Japan

[73] Assignee: NEC Corporation, Tokyo, Japan

[21] Appl. No.: 580,557

[22] Filed: Sep. 11, 1990

[30] Foreign Application Priority Data

Sep. 11, 1989 [JP] Japan ..... 1-232922

[51] Int. Cl.[5] ..... H01Q 3/00; H01Q 3/22

[52] U.S. Cl. ..... 342/360; 342/371

[58] Field of Search ..... 342/368, 371, 372, 377, 342/360; 343/703

[56] References Cited

U.S. PATENT DOCUMENTS

| | | | |
|---|---|---|---|
| H173 | 12/1986 | Claborn et al. | 342/372 |
| 3,999,182 | 12/1976 | Moeller et al. | 342/372 |
| 4,308,539 | 12/1981 | Birch | 342/372 |
| 4,536,766 | 8/1985 | Frazita | 343/372 |
| 4,926,186 | 5/1990 | Kelly et al. | 342/360 |

FOREIGN PATENT DOCUMENTS 62-1303 1/1987 Japan .

*Primary Examiner*—Gregory C. Issing
*Attorney, Agent, or Firm*—Foley & Lardner

[57] ABSTRACT

A phased array antenna having digital pulse shifters, which compensates for changes in characteristics caused by temperature variations. Each shifter is associated with a radiating element. A CPU calculates by simple processing the phase error of a high frequency signal radiated from each radiating element. A correcting amount is also computed by the CPU, which adds the correcting amount to a phase control signal associated with the radiating element of interest. This successfully maintains the phase plane of a phase array antenna, including its characteristics, such as beam shape and direction and side lobe level. Temperature variations have little or no effect on the antenna.

4 Claims, 6 Drawing Sheets

PHASED ARRAY ANTENNA WITH TEMPERATURE COMPENSATING CAPABILITY

BACKGROUND OF THE INVENTION

The present invention relates to a phased array antenna having digital phase shifters and, more particularly, to a phased array antenna with a function of compensating for changes in characteristics ascribable to temperature.

A phased array antenna is capable of scanning a beam electrically, and is used in a microwave landing system (MLS), for example. In MLS, a phased array antenna located on the ground transmits a reciprocating beam to aircraft, while the aircraft measures the interval between a pair of received beams and thereby determines the azimuth and elevation angle thereof. This allows the aircraft to land along a predetermined route. A phase array antenna for the MLS application is generally required to have an accuracy of the order of 1/100 degrees as to beam angle or scanning angle. In practice, however, the characteristics of various components of the antenna, such as a power divider for distributing power to individual antenna elements, are susceptible to temperature since the system itself is situated outdoors. Hence, not only the beam pointing but also the beam shape or the side lobe level are changed and cannot meet the accuracy requirement unless compensation is effected.

In light of this, it has been customary to provide the antenna with an air conditioner. Although the air conditioner is applied for maintaining the temperature around the antenna constant and, therefore, for suppressing the changes in characteristics ascribable to temperature, it brings about various problems, such as the increase in running cost and low reliability.

The use of a monitor manifold associated with a phased array antenna is a conventional approach to reduce the change in beam pointing due to temperature, as disclosed in, for example, U.S. Pat. No. 4,536,766 entitled "SCANNING ANTENNA WITH AUTOMATIC BEAM STABILIZATION" (Aug. 20, 1985). Specifically, while the monitor manifold detects a scanning angle, the scanning timing is changed on the basis of the resultant error. This kind of approach, however, simply corrects the scanning angle by changing the scanning timing. It cannot compensate for the changes in beam shape and side lobe level. As a result, with such a scheme, it is not practicable to prevent the MLS performance from being degraded by the changes in beam shape and side lobe level.

SUMMARY OF THE INVENTION

It is therefore an object of the present invention to provide a phased array antenna capable of sufficiently compensating for not only the changes in beam direction but also the changes in beam shape and side lobe level due to temperature and, thereby, insuring the expected MLS performance.

In accordance with the present invention, in a phased array antenna having a plurality of radiating elements, a power divider for distributing transmitting power to the radiating elements, and a plurality of phase shifters each being connected between the power divider and respective one of the radiating elements, and scanning a beam by controlling the amounts of phase shift of the phase shifters, a characteristic compensating apparatus for the antenna comprises a monitor manifold coupled to the array of the radiating elements for combining outputs radiated from the radiating elements and producing the greatest combined output as a monitor output when the antenna has a predetermined scanning angle, phase error calculating means for calculating, when the antenna radiates a scanning beam of the predetermined angle, phase errors between the outputs of the individual radiating elements and the output of the monitor manifold in response to the combined output of the monitor manifold, and phase shift compensating means for compensating the amounts of phase shift of the individual phase shifters in response to the calculated phase errors.

Thus, the present invention provides not only accuracy of a beam direction but also stability of a beam shape and side lobe level even when temperature changes.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
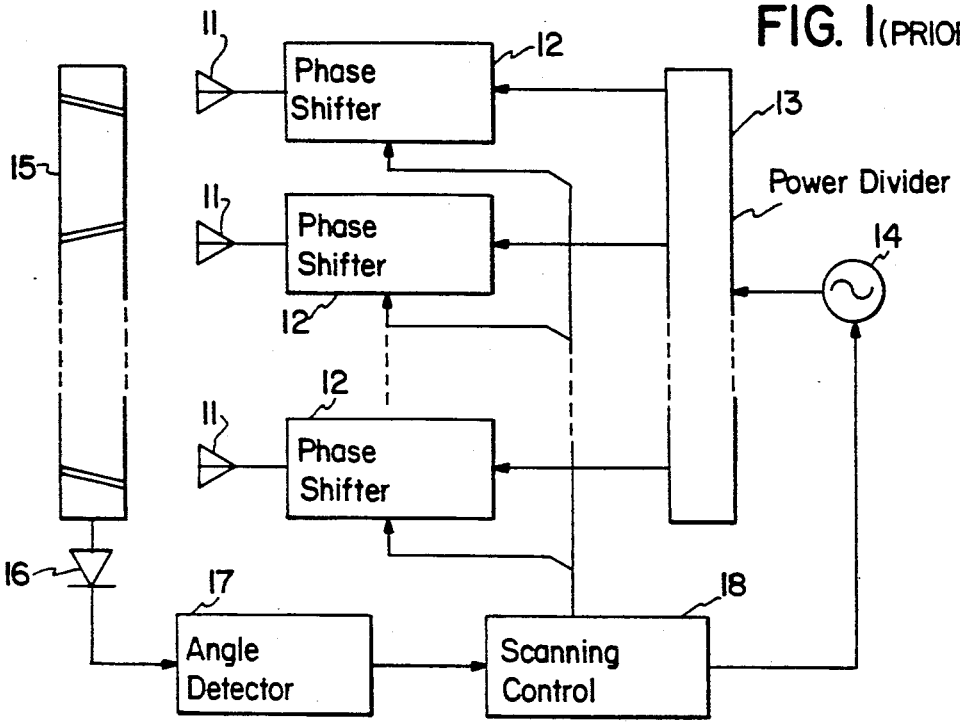
FIG. 1 (PRIOR ART)
FIG. 1 is a block diagram schematically showing a phased array antenna having a prior art temperature compensating apparatus.

To better understand the present invention, a brief reference will be made to conventional temperature compensation of the kind disclosed in U.S. Pat. No. 4,536,766, shown in FIG. 1. As shown, a phased array antenna has a plurality of radiating elements 11 spaced a predetermined distance apart and phase shifters 12 associated one-to-one with the radiating elements 11. A high-frequency signal is fed from a signal generator or transmitter 14 to the individual radiating elements 11 via a power divider 14 and the phase shifters 12. An integral monitor manifold 15 is so disposed along the arrayed radiating elements as to receive a part of a signal radiated from each of the radiating elements 11. The combined output from the manifold 15 is applied to a detector 16 whose output is in turn applied to an angle detector 17. The angle detector 17 detects a scanning angle (receiving angle) on the basis of the pulse interval of the output of the detector 16, converts it into digital data, and feeds the digital data to a scanning control section 18. In response, the control section 18 produces a difference between the detected receiving angle and a certain receiving angle, which is predetermined by the location of the monitor manifold, and changes the scanning timing of the phased array antenna, such that the difference becomes zero.

The integral monitor manifold 15 is generally implemented as a slot array waveguide. Combining a part of the signal from each radiating element 11, as mentioned above, the integral monitor manifold 15 produces a waveform analogous to a waveform receiving at a certain remote point of the predetermined receiving angle $\theta$ in space. The receiving angle $\theta$ of the manifold 15 may be expressed as:

$$\theta = \sin^{-1}\left\{\lambda\left[\frac{1}{\lambda g} - \frac{1}{d}\right]\right\} \quad \text{Eq. (1)}$$

where $\lambda$ is the wavelength of the radiated signal, $\lambda g$ is the wavelength in the waveguide, and d is the distance between adjacent radiating elements 11. Since the above-mentioned receiving angle of the integral monitor manifold 15 is employed as a reference, the manifold is made of Invar or otherwise constructed so as to prevent the angle from varying due to temperature.

Figure 2:
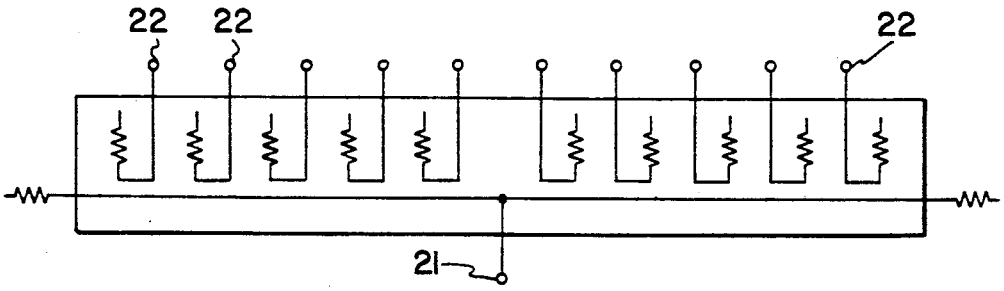
FIG. 2 is a diagram representative of a power divider generally applied to a phased array antenna, which is extremely susceptible to temperature.

FIG. 2 shows a center branch, serial feed type power divider extensively used with phase array antennas. As shown, the power divider has an input terminal 21 connected to the output terminal of the signal generator 14 (FIG. 1) and output terminals 22 connected to the inputs of the individual phase shifters 12 (FIG. 1). The beam pointing ascribable to this type of power divider essentially does not noticeably change in direction in free space despite temperature change. However, the beam shape and the side lobe level each undergoes a substantial change, as will be described with reference to FIG. 3.

Figure 3:
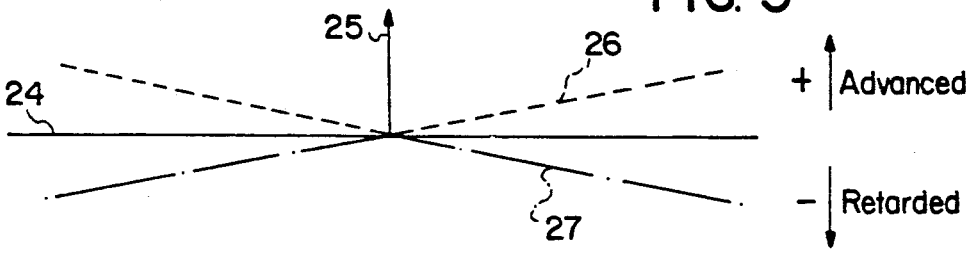
FIG. 3 is a plot chart showing the changes in phase plane due to temperature heretofore observed with a phased array antenna.

In FIG. 3, a solid line 24 is representative of an equivalent phase plane with respect to the arrayed radiating elements under a normal temperature condition, and an arrow 25 is representative of a beam direction. Generally, a dielectric substrate implementing a power divider changes more in dielectric constant than in the rate of linear expansion with temperature. Hence, as the temperature rises, the phase plane 24 changes to a phase plane 26 represented by a dashed line; as the temperature drops, it changes to a phase plane 27 represented by a dash-and-dot line. On such a change of the phase plane, the beam shape and the side lobe level each undergoes a substantial change although the beam pointing remains the same in the direction.

Figure 4:
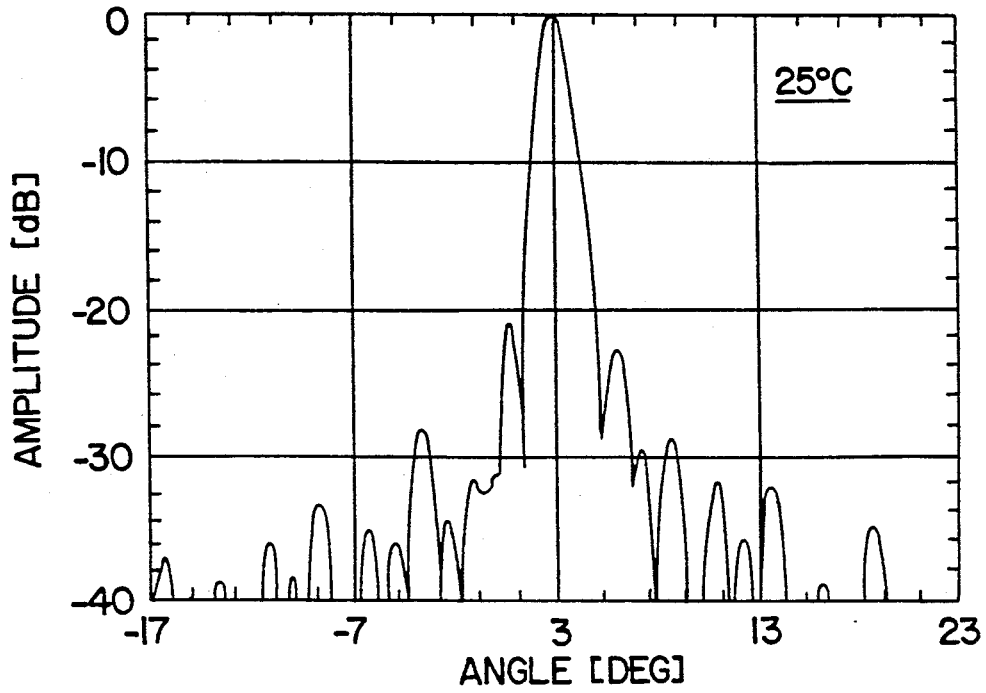
FIGS. 4 and 5 are graphs showing radiation patterns heretofore observed with a phase array antenna at normal temperature and at high temperature, respectively.
Figure 5:
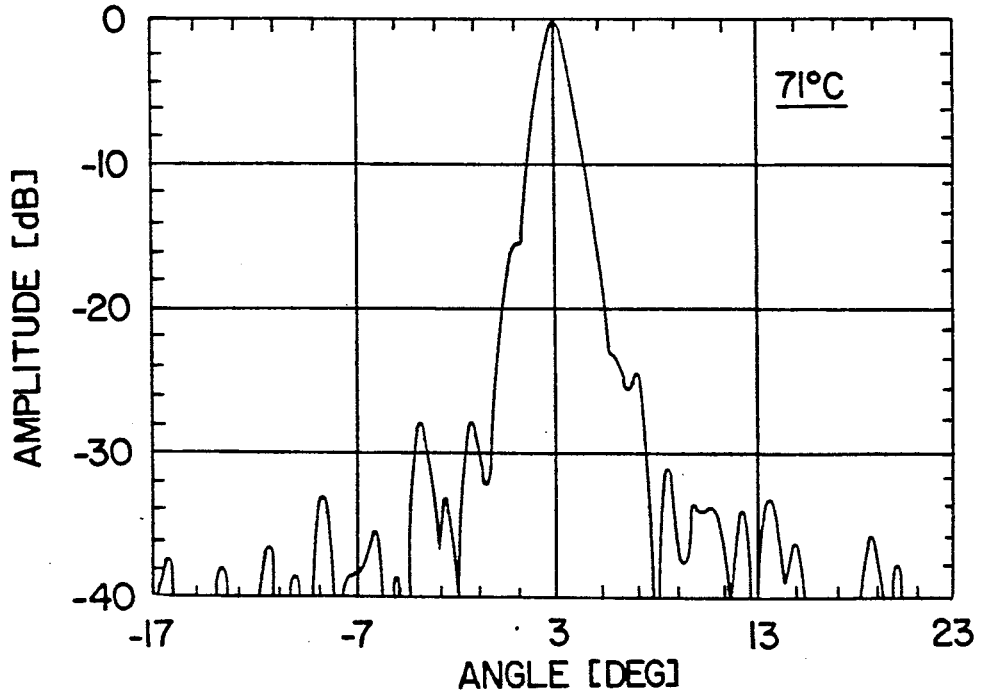

FIGS. 4 and 5 indicate simulated results showing how the change in phase plane effects the beam pattern. Simulations were made under the following conditions:

(1) number of radiating elements: 78
(2) distance between radiating elements: 35 mm
(3) frequency: 5090.7 MHz
(4) phase shifter: 4-bit digital phase shifter with quantizing error
(5) radiating element pattern: cos $\theta$
(6) set beam direction: 3°
(7) feed line amplitude distribution: Taylor's distribution (side lobe level −30 dB, $\bar{n}=5$)

Specifically, FIGS. 4 and 5 show a radiation pattern at normal temperature (25° C.) and a radiation pattern at 71° C., respectively. In these cases, the dielectric constant is varied in accordance with the temperature. As these figures indicate, the side lobe level increases from −20.5 dB to −15.5 dB on the increase in temperature.

Figure 6:
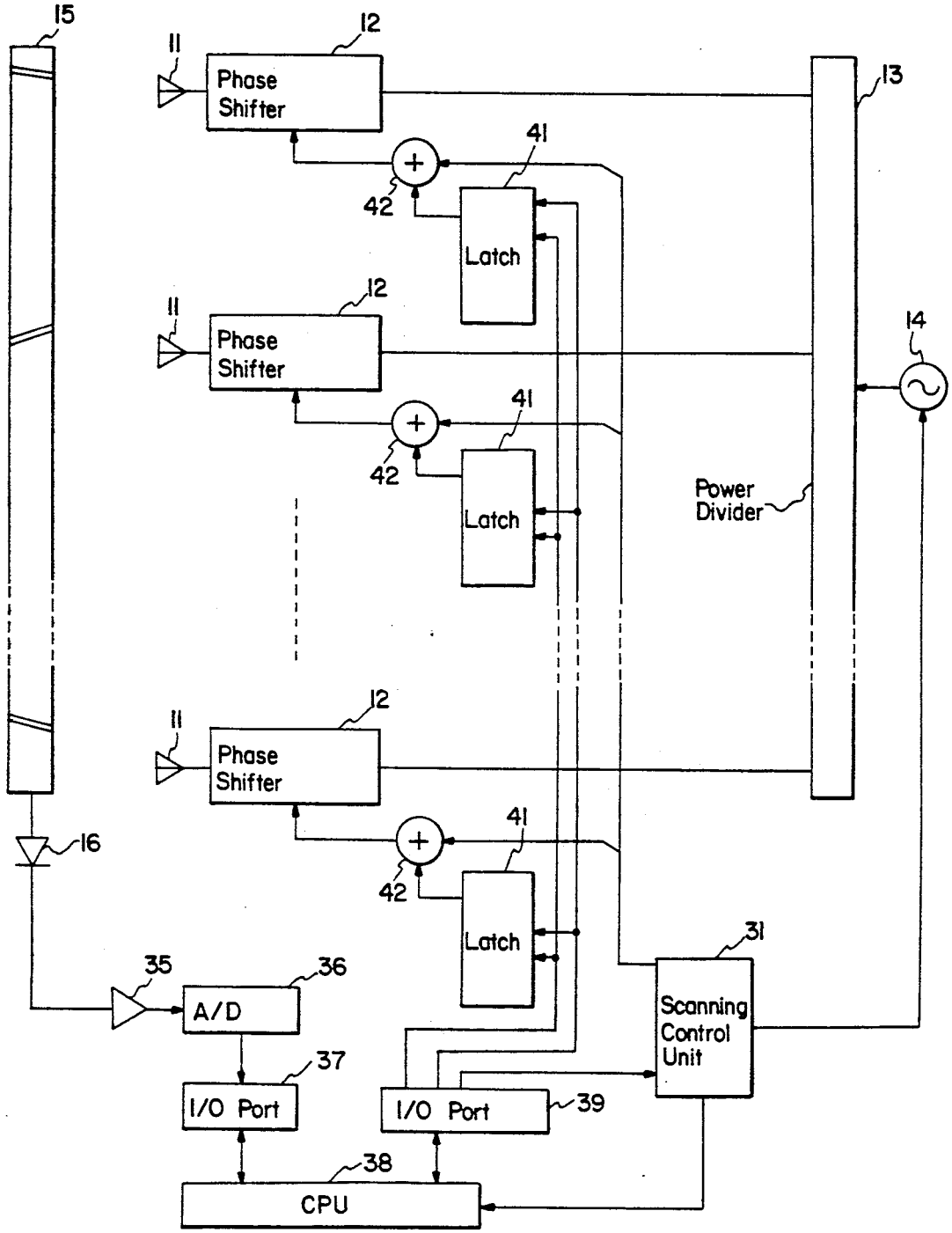
FIG. 6 is a block diagram schematically showing a phase array antenna with a temperature compensating apparatus embodying the present invention.

Referring to FIG. 6, a temperature compensating apparatus for a phased array antenna embodying the present invention is shown. The illustrative embodiment is identical with the prior art of FIG. 1 as far as the radiating elements 11, phase shifters 12, signal generator 14, integral monitor manifold 15 and detector 16 are concerned. A scanning control unit 31 delivers a transmission timing to the transmitter 14, phase control data for beam scanning to the phase shifters 12, and a control timing to a CPU (Central Processing unit) 38. An operational amplifier 35 amplifies the output of the detector 16. An analog-to-digital converter (ADC) 36 converts the output of the operational amplifier 35 into digital data. An input/output (I/O) port 37 receives the digital data from the ADC 36. The CPU 38 takes in data at predetermined timings to perform compensation operations. Latches 41 each are associated with respective phase shifters 12 for latching phase correcting data. Adders 42 are each also associated with respective ones of the phase shifters 12 for adding the correcting data from the associated latch 41 to the phase shift control data delivered from the scanning control section 31. Based on the resulting sum, the adder 42 controls the amount of phase shift to be effected by the associated phase shifter 12. To this end, an I/O port 39 transfers the correcting data computed by the CPU 38 to the latches 41.

Figure 7A:
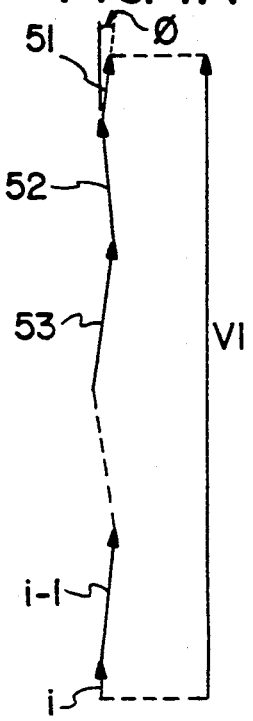
FIGS. 7(A) through 7(D) are diagrams explaining a procedure for calculating a phase error particular to the illustrative embodiment.

The computing operation for the compensation particular to the illustrative embodiment is effected during an interval between successive scanning sequences for MLS (timings will be described later specifically). First, a sequence of compensating operation steps will be described. In the event compensation is needed, the scanning control section 31 loads each phase shifter 12 with a predetermined amount of phase shift so that the beam is directed at a predetermined receiving angle particular to the integral monitor manifold 15. In this condition, the combined signal outputted from the manifold 15 should, in principle, be greatest. In practice, however, the phases of the outputs of the individual radiating elements 11 have errors due to the changes in the characteristics of power divider, phase shifters and transmission cable which are in turn ascribable to ambient conditions such as temperature, so that the combined signal is not always greatest in the above condition in the strict sense. Specifically, as shown in FIG. 7(A), it is assumed that the combined output V1 is made up by a combination of outputs 51, 52, 53, . . . , i-l, i of the individual radiating elements 11 which are different from one another although substantially in-phase. In the illustrative embodiment, the differences in phase between the outputs (51, 52, 53, . . . i-l, i) of the individual radiating elements 11 and the combined output V1 are calculated and the phase compensating data to be stored in the latches 41 are then produced on the basis of the calculated differences.

Figure 7B:
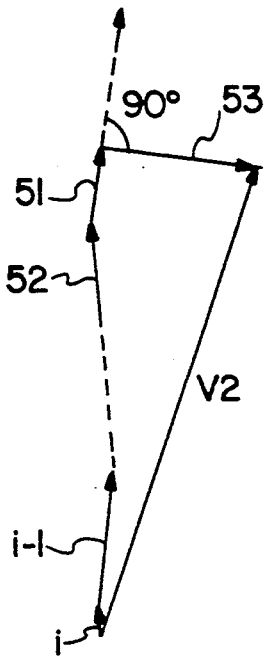
Figure 7C:
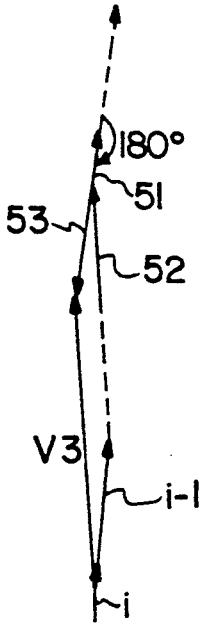
Figure 7D:
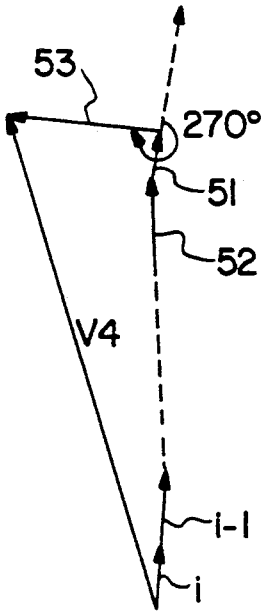

Under the control of CPU 38, the amount of phase shift of each phase shifter 12 is so set as to direct the beam at the predetermined receiving angle particular to the manifold 15. Subsequently, one of the phase shifters 21 whose phase error is to be calculated is designated under the control of the CPU 38 and the scalar of the combined output V1, of this instant is measured (FIG. 7(A)). Then, the phase of the phase shifter 21 of interest is sequentially advanced (or retarded) by 90° at a time so as to measure the resultant scalars V2, V3 and V4 (FIGS. 7(B), 7(C) and 7(D)). At this instant, the phase error $\phi$ is calculated by:

$$\phi = \tan^{-1}\frac{V4 - V2}{V1 - V3} \qquad \text{Eq. (2)}$$

For the principle of such a procedure for calculating the phase error $\phi$, a reference may be made to Japanese patent laid-open publication No. 001303/1987.

Having calculated the phase difference $\phi$ of the phase shifter 21 of interest, the CPU 38 judges whether the phase error $\phi$ is greater than a predetermined threshold value. If the result of judgement is positive, the CPU 38 determines that the designated phase shifter 21 needs correction and computes correcting data C. Assuming that the phase shifters 21 are each implemented as a 4-bit digital phase shifter, including a PIN diode, the CPU 38 determines that correction is necessary when the phase error $\phi$ is greater than $\pm 11.25°$. The correction data C is computed by:

$$\left.\begin{aligned} C &= -INT\frac{\phi + 11.25}{22.5} \quad (\phi > 0) \\ C &= INT\frac{11.25 - \phi}{22.5} \quad (\phi < 0) \end{aligned}\right\} \qquad \text{Eq. (3)}$$

where INT means the absolute value, and the fractions are omitted. The computed correcting data C is delivered via the I/O port 39 together with an address representative of the phase shifter 12 of interest. The latch 41 associated with the designated phase shifter 12 detects the address and then, stores the correcting data C. In this manner, the CPU 38 completes a sequence of steps of calculating a phase error $\phi$, computing correcting data C, and storing the data C in the latch 41 with a particular phase shifter 12. Thereafter, the CPU 38 sequentially repeats such a sequence with the other phase shifters 12 one after another.

In this embodiment, the accuracy with which the phase error $\phi$ of each phase shifter 12 can be calculated depends on the signal-to-noise (S/N) ratio of the detector 16 and operational amplifier 35. Assume a specific case wherein the feed amplitude distribution set up by the power divider 13 is the Taylor's distribution having a side lobe level of $-30$ dB and $\bar{n}$ of 5, sixty-two radiating elements 11 are provided, the transmitting power is 44 dBm, the feed loss is 6 dB, the antenna gain is 20 dB, the coupling ratio of the radiating elements 11 and the integral monitor manifold 15 is $-45$ dB, and the monitor loss is 3 dB. In such a case, the signal radiated from the radiating elements 11 located at the farthest sides is smallest in radiating power. To measure the phase of the smallest signal with accuracy of the order of 6° ($\frac{1}{4}$ bit of 4-bit digital phase shifter), averaging technique is necessary. Specifically, in the illustrative embodiment, the scalars V1 to V4 of the combined outputs are measured several times ten times (for example, eighty times), the measured scalars are averaged, and then Eq. (2) is solved with the resultant averaged scalars.

The operating timings for compensation in accordance with the present invention will be described in relation to a MLS elevation guiding system and with reference to FIG. 8. As represented by a timing $TC_1$, MLS has a prescribed full-cycle timing whose period is 615 ms. In the full-cycle timing, two iterative sequences $SEQ_1$ and $SEQ_2$ appear four times each. A timing $TC_2$ is indicative of the end of the full cycle. As represented by a timing $TC_3$, the sequences $SEQ_1$ and $SEQ_2$ each has three transmission timings each having a duration of 5.6 ms. It follows that the actual transmitting time assigned to elevation guide is not more than 22% of the 615 ms full cycle, i.e., the remaining 78% is the suspension or pause time. While transmission timings for azimuth guide and the like are arranged in such a manner as not to overlap the pause time, the CPU 38 is capable of completing the previously stated arithmetic operations satisfactorily at least within the pause time.

Figure 8:
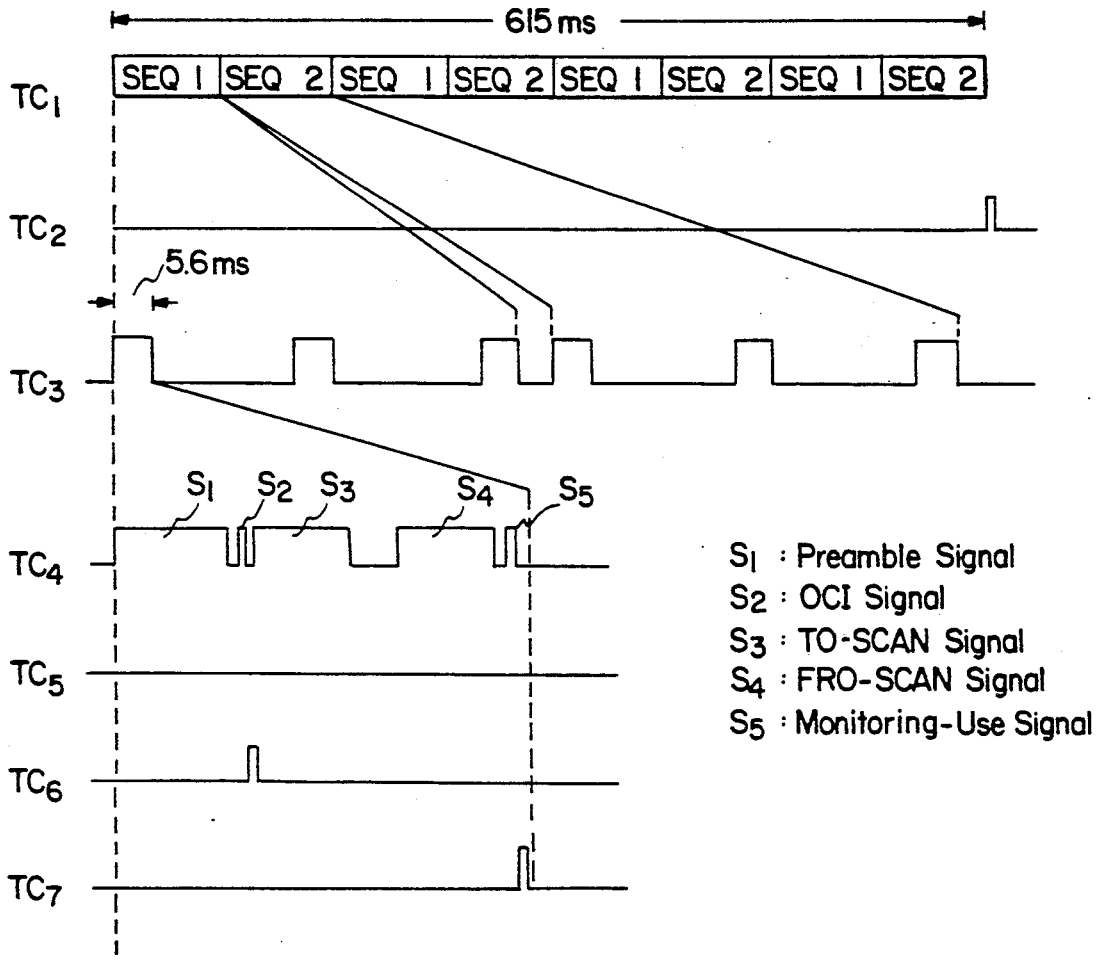
FIG. 8 is a timing chart showing a compensation operation in the embodiment.

As indicated by a timing $TC_4$ in FIG. 8, a single transmission timing of 5.6 ms contains a preamble signal $S_1$ including system identification (ID) information, an OCI (Out of Coverage Identification) signal $S_2$, a TO-SCAN signal $S_3$ for beam scanning, a FRO-SCAN signal $S_4$ also adapted for beam scanning, and a monitoring-use signal $S_5$. The monitoring-use signal $S_5$ is the signal which is transmitted at the receiving angle determined by the integral monitor manifold 15 (FIG. 6) and which does not influence ordinary MLS operation. The interrupt timings for accessing the CPU 38 for compensation operation are predetermined in relation to the above operations as interrupt timings $TC_5$, $TC_6$ and $TC_7$ by way of example. At the interrupt timing $TC_5$, the CPU 38 designates one line associated with one phase shifter to be measured. At the interrupt timing $TC_6$, the CPU 38 designates a particular amount of phase shift of the designated phase shifter 21, i.e., one of 0°, 90°, 180° and 270°. Further, at the interrupt timing $TC_7$, the CPU 38 takes in data (V1, V2, V3 or V4) via the I/O port 37 after radiating the monitoring-use signal $S_5$. Thereafter, the calculation of a phase error $\phi$ and the computation of correcting data C will be performed in the subsequent pause time.

Figure 9:
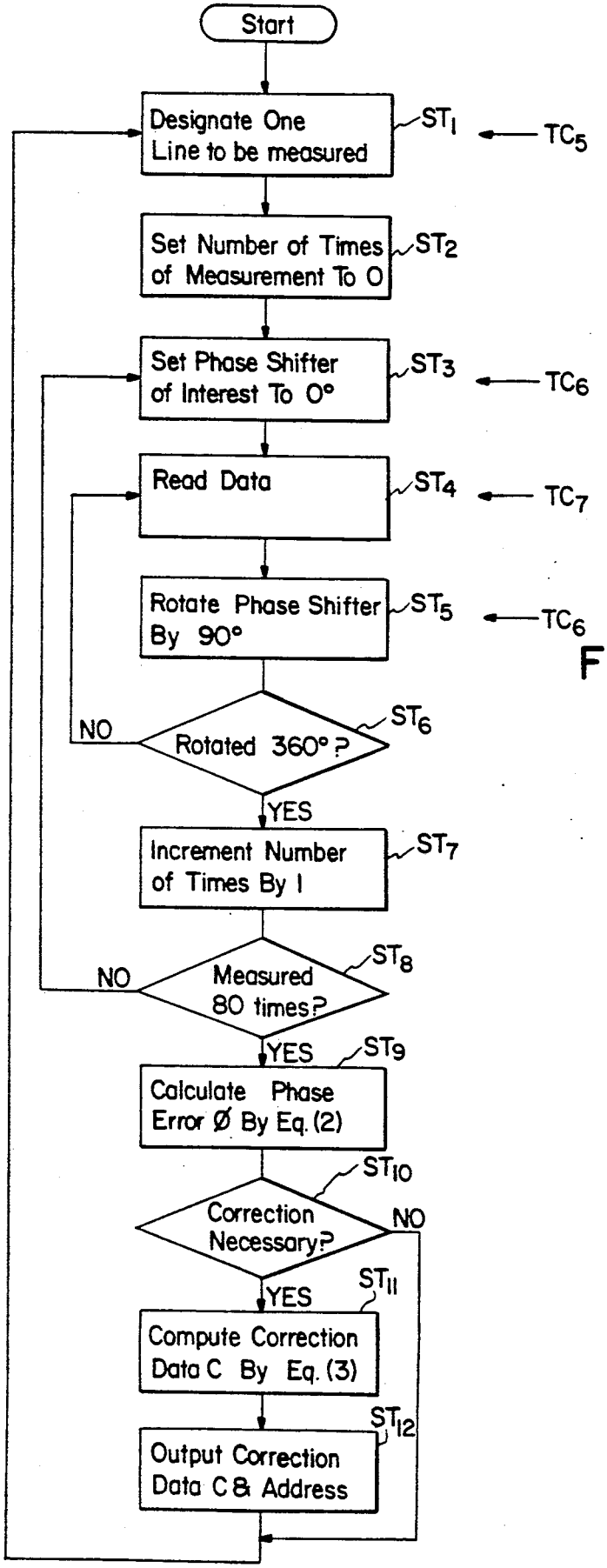
FIG. 9 is a flowchart demonstrating the compensation operation in the embodiment.

FIG. 9 is a flowchart demonstrating the compensating operation procedure of the present invention. As shown, the procedure begins with a step $ST_1$ of designating one line to be measured at the interrupt timing $TC_5$. In this condition, the number of times that measurement is to be effected is set to zero ($ST_2$). Then, the phase shifter 12 of interest is set to 0° phase at the interrupt timing $TC_6$ ($ST_3$). At the subsequent interrupt timing $TC_7$, data V1 is taken in ($ST_4$). At the next interrupt timing $TC_6$, the phase of the designated phase shifter 12 is rotated by 90° (step $ST_5$). Thereupon, whether or not the phase of the phase shifter 12 has been rotated by 360°, i.e., whether or not the data V1, V2, V3 and V4 have been read is judged ($ST_6$). If the answer of the step $ST_6$ is YES, the number of measurements is counted up ($ST_7$). The steps described so far are repeated until the measurement has been performed eighty times. When the eightieth measurement has been completed as determined in a step $ST_8$, a phase error $\phi$ is calculated in the subsequent pause time on the basis of the averaged data $\overline{V1}$, $\overline{V2}$, $\overline{V3}$ and $\overline{V4}$ and by using Eq. (2) ($ST_9$). Then, whether or not the determined phase error $\phi$ is greater than a predetermined threshold value is determined ($ST_{10}$). If the answer of the step $ST_{10}$ is YES, correcting data C is computed by using Eq. (3) ($ST_{11}$). This is followed by a step $ST_{12}$ for outputting the correcting data C and the address data of the latch 41 associated with the designated phase shifter 12.

The compensation apparatus of the illustrative embodiment was incorporated in a MLS elevation guiding system to measure the stability thereof with respect to the angular accuracy. The measurement showed that the angle fluctuates only by the order of ±1/100° at maximum. Hardly any change was observed in the beam width and side lobe level.

In summary, the present invention calculates the phase error of a high frequency signal radiated from each radiating element by simple processing, computes a correcting amount on the basis of the calculated phase error and adds the correcting amount to a phase control signal associated with the radiating element of interest. This is successful in maintaining the phase plane of a phased array antenna and, therefore, various characteristics of the antenna such as the beam shape, beam direction and side lobe level substantially constant at all times. Thus, the present invention realizes a phased array antenna having an excellent temperature characteristic.

What is claimed is:

1. A characteristic compensating apparatus for a phased array antenna comprising a power divider for dividing transmitting power into a plurality of outputs, a plurality of phase shifters each receiving a respective one of said plurality of outputs of said power divider, a plurality of radiating elements arranged in an array each for receiving an output of a respective one of said plurality of phase shifters, and control means for controlling each of said plurality of phase shifters to have a phase-shift such that said phased array antenna delivers a scanning beam having a desired scanning angle, and characteristic compensating apparatus comprising:

monitoring means for receiving and combining outputs radiated from said plurality of radiating elements and for outputting as monitor outputs combined outputs which are associated with phase-shifts of said each phase shifter and represents a scalar when said control means controls said plurality of phase shifters to have respective first phase-shifts such that said phased array antenna has a predetermined scanning angle and, then, said control means controls each phase shifter to have 90°, 180° and 270° phase-shifts in addition to said first phase-shift;

phase error calculating means responsive to said monitor outputs for calculating a phase error of an output radiated from a radiating element associated with said each phase shifter; and a plurality of latches each associated with a respective one of said plurality of phase shifters, each storing correction data determined in accordance with said phase error calculated by said phase error calculating means, whereby the amount of phase shift of said phase shifters is controlled with a combination of said phase-shift controlled by said control means and said correction data stored in said latches to deliver the scanning beam having the desired scanning angle from said phased array antenna.

2. An apparatus as claimed in claim 1, wherein said apparatus is applied to a microwave landing system, said monitoring means, said phase error calculating means and said latches performing operations thereof during periods in which beam scanning for microwave landing is suspended.

3. An apparatus as claimed in claim 2, wherein said monitoring means outputs said monitor outputs $V_1$, $V_2$, $V_3$ and $V_4$ in accordance with said phase-shifts of 0°, 90°, 180° and 270°, said phase error calculating means outputs said phase error $\phi$ given by $$\phi = \tan^{-1}\frac{V_4 - V_2}{V_1 - V_3}$$

said phase shifter comprises an n-bit digital phase shifter, and said latch stores said correction data C given by $$C = -INT\frac{\phi + \frac{180}{2^n}}{\frac{360}{2^n}} \quad (\phi > 0)$$

or $$C = -INT\frac{\frac{180}{2^n} - \phi}{\frac{360}{2^n}} \quad (\phi < 0)$$

wherein INT means the absolute value.

4. An apparatus as claimed in claim 3, wherein said phase shifter comprises a 4-bit digital phase shifter, and said correction data C are given by $$C = -INT\frac{\phi + 11.25}{22.5} \quad (\phi > 0)$$

or $$C = INT\frac{11.25 - \phi}{22.5} \quad (\phi < 0)$$

* * * * *